US009739057B2

(12) United States Patent
Bergman et al.

(10) Patent No.: US 9,739,057 B2
(45) Date of Patent: Aug. 22, 2017

(54) CEILING SYSTEM

(71) Applicant: Armstrong World Industries, Inc., Lancaster, PA (US)

(72) Inventors: Todd Bergman, Lititz, PA (US); Scott Huntzinger, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 14/721,469

(22) Filed: May 26, 2015

(65) Prior Publication Data

US 2015/0330074 A1 Nov. 19, 2015

Related U.S. Application Data

(63) Continuation of application No. 14/099,693, filed on Dec. 6, 2013, now Pat. No. 9,038,326.

(Continued)

(51) Int. Cl.
*E04B 1/82* (2006.01)
*E04B 9/28* (2006.01)

(Continued)

(52) U.S. Cl.
CPC ..... *E04B 9/28* (2013.01); *E04B 1/8209* (2013.01); *E04B 9/001* (2013.01); *E04B 9/04* (2013.01);

(Continued)

(58) Field of Classification Search
CPC . E04B 9/001; E04B 9/003; E04B 9/00; E04B 9/22; E04B 9/24; E04B 9/241;

(Continued)

(56) References Cited

U.S. PATENT DOCUMENTS 3,153,304 A 10/1964 Evangelista
3,774,024 A * 11/1973 Deaton ..... E04B 9/366 248/343

(Continued)

FOREIGN PATENT DOCUMENTS

CN 202390986 U 8/2012

OTHER PUBLICATIONS

International Search Report and Written Opinion of International Searching Authority, mailed Mar. 18, 2014, for Corresponding International Application No. PCT/US1373720, Filed Dec. 6, 2013. WO.

(Continued)

*Primary Examiner* — Brian Mattei
(74) *Attorney, Agent, or Firm* — Craig M Stemer

(57) ABSTRACT

A ceiling system in one embodiment includes a support grid including intersecting grid support members and grid openings formed between the grid support members. A vertical baffle is positioned in a grid opening and is attached to the support grid. The baffle includes opposing front and rear faces extending between opposing lateral sides of the baffle. First and second mounting grooves formed in the baffle engage and support the baffle from the grid. In one embodiment, one of the mounting grooves is disposed in each lateral side to support the baffle from opposite sides. The baffle may further include a third mounting groove formed in the rear face which engages the support grid to help align and squarely register the baffle with respect to the grid for clean linear visuals. In one embodiment, the grid support members may have a standard T-shaped cross section.

21 Claims, 15 Drawing Sheets

Related U.S. Application Data

(60) Provisional application No. 61/734,031, filed on Dec. 6, 2012.

(51) Int. Cl.

| | |
|---|---|
| ***E04B 9/00*** | (2006.01) |
| ***E04B 9/10*** | (2006.01) |
| ***E04B 9/04*** | (2006.01) |
| ***E04B 9/06*** | (2006.01) |
| ***E04B 9/36*** | (2006.01) |

(52) U.S. Cl.
CPC ..... *E04B 9/067* (2013.01); *E04B 9/10* (2013.01); *E04B 9/366* (2013.01); *E04B 2001/829* (2013.01)

(58) Field of Classification Search
CPC ... E04B 2/248; E04B 9/34; E04B 9/36; E04B 9/366; E04B 9/10; E04B 9/363; E04B 9/28; E04B 1/8209; E04B 9/04; E04B 9/067; E04B 2001/829
USPC ..... 52/144, 220.6, 220.7, 238.1, 506.07, 52/506.08, 510, 588.1, 747.1
See application file for complete search history.

(56) References Cited

U.S. PATENT DOCUMENTS

| | | | | |
|---|---|---|---|---|
| 4,137,678 | A * | 2/1979 | Varlonga | E04B 9/34 52/144 |
| 5,241,799 | A * | 9/1993 | Jahn | E04B 9/345 52/28 |
| D658,785 | S | 5/2012 | Koennecke | |
| D658,786 | S | 5/2012 | Koennecke | |
| 2006/0157297 | A1* | 7/2006 | D'Antonio | E04B 9/001 181/287 |
| 2007/0033902 | A1* | 2/2007 | Waters | E04B 9/127 52/800.1 |
| 2009/0173030 | A1 | 7/2009 | Gulbrandsen et al. | |
| 2010/0037533 | A1* | 2/2010 | Anderson | G09F 7/18 52/39 |
| 2012/0317915 | A1* | 12/2012 | Koennecke | E04B 9/366 52/506.09 |

OTHER PUBLICATIONS

Search Report for corresponding Singapore Patent Application No. 11201504445, dated Oct. 26, 2015. SG.
Search Report for corresponding CN No. 2013800631163, dated May 12, 2016. CN.

* cited by examiner

CEILING SYSTEM

CROSS-REFERENCE TO RELATED APPLICATIONS

The present application is a continuation of U.S. patent application Ser. No. 14/099,693, filed on Dec. 6, 2013, which in turn claims the benefit of U.S. Provisional Patent Application Ser. No. 61/734,031, filed Dec. 6, 2012. The disclosures of the above patent applications are incorporated herein by reference.

FIELD OF THE INVENTION

The present invention relates to suspended ceiling systems, and more particularly to a ceiling systems having vertically hung baffles.

BACKGROUND OF THE INVENTION

One type of ceiling system includes vertical baffles which are hung individually utilizing customized independent hanger hardware and specially-configured horizontal supports. Installation may be time intensive to carefully align and register these baffles relative to one another on the supports for a proper and aesthetically pleasing ceiling installation. Moreover, these custom vertical baffle systems do not work with standard overhead ceiling support grids and continuous suspended ceiling systems requiring. Therefore, existing overhead ceiling grids cannot readily be retrofitted to accommodate vertical baffles requiring replacement of the entire support grid, thereby increasing material and labor costs.

An improved ceiling system with vertical baffles for use in standard ceiling support grid and continuous ceiling systems is desired.

SUMMARY OF THE INVENTION

The present invention provides a ceiling system including vertical baffles which can be detachably mounted on a standard suspended ceiling support grid having inverted T-shaped grid support members in a secure and stable manner. The vertical baffles may be directly attached to and supported from the ceiling grids without special mounting hardware in some embodiments, thereby providing a baffle or blade system readily adapted for retrofit installations. Moreover, the standard ceiling grid automatically provides proper alignment and registration of the vertical baffles relative to one another for creating clean linear visuals without undue installation procedures or labor. Furthermore, the vertical baffles can be readily integrated with standard horizontal ceiling tiles in the standard support grid for forming a complete continuous ceiling system.

According to one exemplary embodiment, a ceiling system includes a suspended support grid including a plurality of intersecting grid support members arranged horizontally and grid openings formed between the grid support members. A vertical baffle is positioned in a grid opening and attached to the support grid. The baffle includes opposing front and rear faces extending between opposing lateral sides of the baffle. First and second mounting grooves are formed in the baffle, wherein the first and second grooves engage different grid support members to support the baffle from the support grid. The baffle may further include a third mounting groove formed in the rear face of the baffle which engages a grid support member of the support grid.

In another embodiment, a ceiling system includes a suspended support grid including a plurality of intersecting grid support members arranged horizontally and grid openings formed between the grid support members. A vertical baffle is positioned in a grid opening and attached to the support grid. The baffle includes a top, a bottom, and opposing front and rear faces extending between opposing lateral sides of the baffle. A face mounting groove is formed in the rear face of the baffle and a side mounting groove is formed in each lateral side of the baffle. The face and side mounting grooves engage the support grid to support the baffle.

A method for mounting a vertical baffle to a support grid is provided. The method includes: providing a suspended support grid including a plurality of intersecting grid support members arranged horizontally and grid openings formed between the grid support members; positioning a vertical baffle at least partially within a grid opening; engaging a first mounting groove formed in a first lateral side of the baffle with a first grid support member; and engaging a second mounting groove formed in a second opposing lateral side of the baffle with a second grid support member by rotating the vertical baffle horizontally; wherein the baffle is supported by the support grid.

BRIEF DESCRIPTION OF THE DRAWINGS

The features of the exemplary embodiments of the present invention will be described with reference to the following drawings, where like elements are labeled similarly, and in which.

Figure 1:
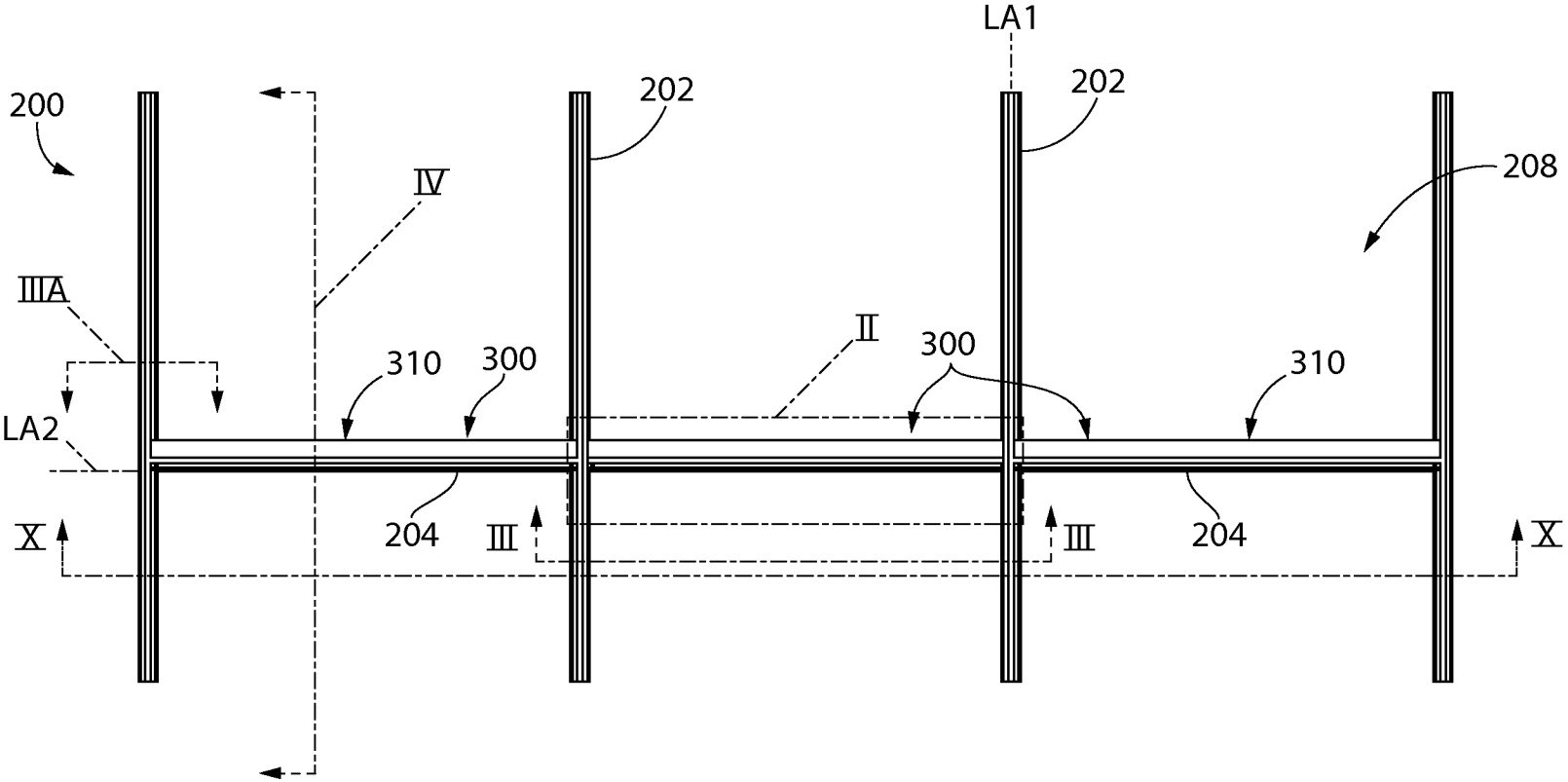
FIG. 1 is a top plan view a ceiling system including an overhead suspended support grid and vertical baffles hung from the grid according to the present disclosure.
Figure 2:
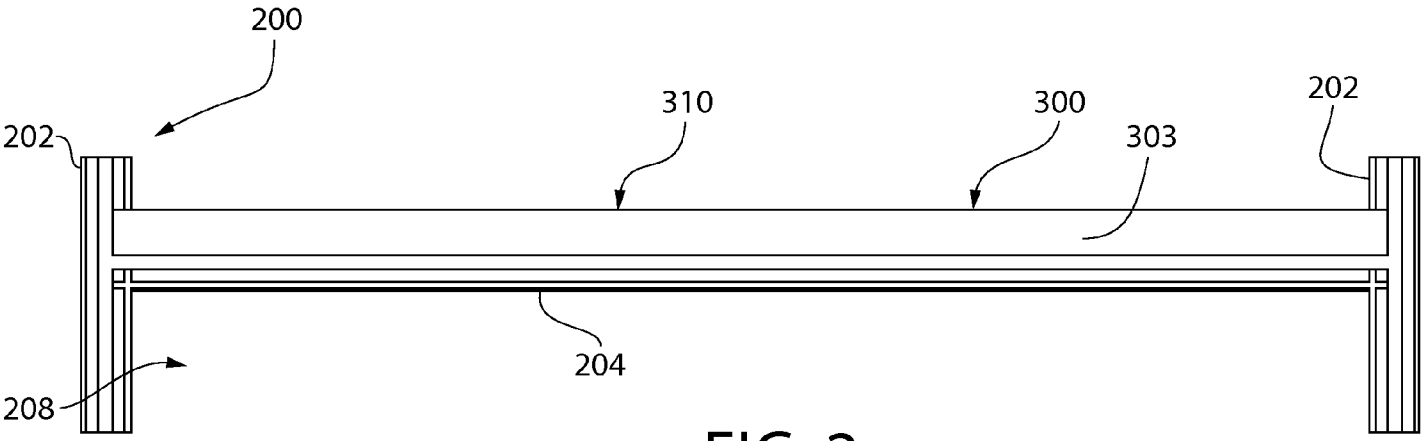
FIG. 2 is an enlarged top plan detail from FIG. 1.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE EMBODIMENTS

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIG. 1 depicts an exemplary embodiment of a ceiling system 100 according to the present disclosure. The ceiling system 100 includes an overhead support grid 200 mountable in a suspended manner from an overhead building support structure. Support grid 200 includes a plurality intersecting longitudinal grid support members 202 and lateral grid support members 204. Longitudinal and lateral grid support members 202, 204 are elongated in shape having a length greater than their respective length (e.g. at least twice), and in various embodiments lengths substantially greater than their widths (e.g. 3 times or more). Longitudinal grid support member 202 may have a substantially greater length than lateral grid support member 204 and form "runners" which are maintained in a substantially parallel spaced apart relationship by the lateral grid support members. The lateral grid support members 204 may be attached between adjacent (but spaced apart) longitudinal grid support members 202 at appropriate intervals using any suitable permanent or detachable manner employed in the art. The combination of interconnected longitudinal and lateral grid support members 202, 204 provides lateral stability to the support grid 200.

In one embodiment, grid support members 202 and 204 may be horizontally oriented when installed. It will be appreciated, however, that other suitable mounted orientations of support members 202, 204 such as angled or slanted (i.e. between 0 and 90 degrees to horizontal). Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 configured for insertion and mounting of the ceiling vertical baffles 300. In some embodiments, the grid support members 202, 204 may be arranged in an orthogonal pattern wherein support members intersect at right angles to form rectilinear grid openings 208 such as squares or rectangles (in top plan view). The terminal ends of the lateral grid support members 204 may be configured to interlock with the transversely oriented longitudinal grid support members 202 at right angles to form the rectilinear grid pattern in a well-known manner in the art. Any suitable interlocking mechanism and configuration may be used, including for example without limitation interlocking tabs and slots, brackets, clips, etc. Accordingly, the present invention is not limited by the manner of attachment used.

In transverse cross section, longitudinal and lateral grid support members 202, 204 may have a standard generally inverted T-shaped configuration when in an installed position suspended from an overhead ceiling support structure via an attachment mechanism such as without limitation fasteners, hangers, wires, cables, rods, struts, etc. Grid support members 202, 204 may include a longitudinally-extending horizontal bottom flange 210, a bulbous top stiffening channel 220, and a vertical web 212 extending upwards from the flange to the stiffening channel. The grid support members 202, 204 each define a respective longitudinal axis LA1, LA2 and axial directions. Web 212 may be centered between opposing longitudinally extending edges 214 of flange 210 in one embodiment. Bottom flange 210 defines upward facing bearing surfaces 201 configured and arranged to engage a downward facing bearing surface 301 formed on baffle 300. Bearing surfaces 201 are disposed on each side of web 212 and extend laterally outwards from the web to opposed edges 214 of the bottom flange 210. In one embodiment, edges 214 may have a slightly enlarged bulbous configuration in transverse cross-section (see, e.g. FIGS. 3A and 4), which may assist with engaging mounting grooves in vertical baffle 300. Bottom flange 210 further defines a bottom surface 206 facing downwards away from the flange and towards a room or space below the support grid 200. Bottom surface 206 defines a horizontal reference plane for the overhead support grid 200. Vertical baffle 300 comprises upper and lower sections 303, 305 extending above and below the bottom flange 210 of grid support members 202, 204 respectively when the baffles are fully mounted on the grid, as further described herein.

Grid support members 202, 204 may be made of any suitable metallic or non-metallic materials structured to support the dead weight or load of baffles 300 without undue deflection. In some preferred but non-limiting embodiments, the grid support members may be made of metal including aluminum, titanium, steel, or other.

Figure 5:
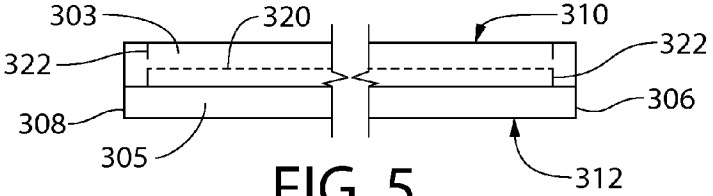
FIG. 5 is a top plan view of the vertical baffle of FIG. 1.
Figure 6:
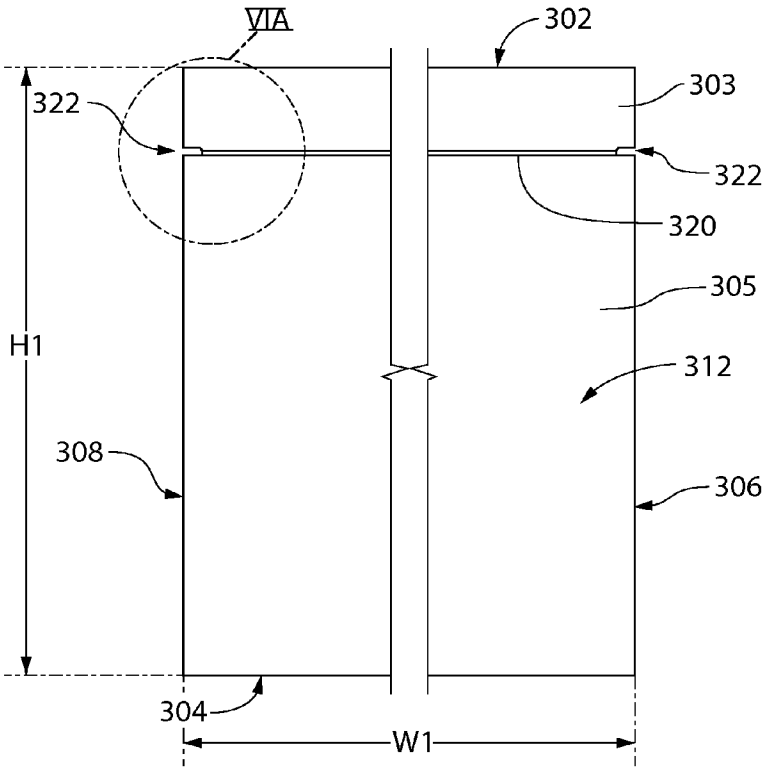
FIG. 6 is a rear elevation view thereof.
Figure 7:
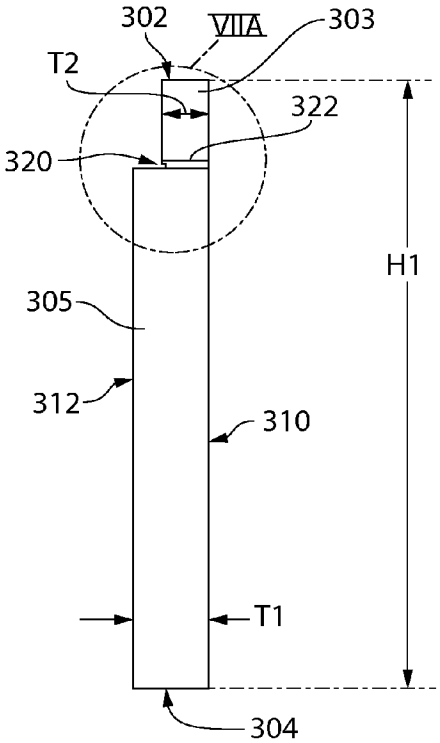
FIG. 7 is a side elevation view of the vertical baffle of FIG. 5.

FIGS. 5-7 (inclusive of all subparts) show vertical baffles 300 alone in greater detail. Each baffle 300 has a generally flat tile or panel-like body including a top 302, bottom 304, opposing lateral sides 306, 308, and opposing front and rear faces 310, 312 respectively. Each baffle defines a width W1, a height H1, and thicknesses T1 and T2 (as further described herein). In one embodiment, the peripheral sides 306, 308 may have straight edges in front/rear profile and form substantially parallel side surfaces extending vertically (see, e.g. FIG. 6).

Front and rear faces 310, 312 may each define substantially flat regular surfaces in side profile (see, e.g. FIG. 7). In other possible shapes that may be provided, the front and rear faces 310, 312 may have irregular surfaces including various undulating patterns, designs, textures, perforations, ridges/valleys, wavy raised features, or other configurations for aesthetic and/or acoustic (e.g. sound reflection or dampening) purposes. Accordingly, front and rear faces 310, 312 are not limited to any particular surface profile. Front and rear faces 310, 312 of baffles 300 may be substantially parallel to each other in some embodiments (see, e.g. FIG. 7). In other possible embodiments, front and rear faces 310, 312 may be angled or slanted in relation to each other to form baffles having a sloping face surfaces. The invention is therefore not limited to any of the foregoing constructions.

With continuing reference to FIGS. 5-7 inclusive, baffles 300 each include a face mounting groove 320 and at least one side mounting groove 322 each configured for engaging bottom flange 210 of grid support members 202, 204. In one embodiment, two opposing side mounting grooves 322 may be provided to support each lateral side 306, 308 from grid support members 202 or 204. In yet other possible embodiments, two opposing side mounting grooves 322 may be provided without a face mounting groove 320. In preferred embodiments, both a face and two side mounting grooves 320, 322 may be provided for optimal support and square alignment of the vertical baffle 300 with respect to the support grid 200 to create clean linear visuals.

Face mounting groove 320 is formed into the rear face 312 of baffle 300 and extends laterally across the face between lateral sides 306 and 308. In one embodiment, face mounting groove 320 extends completely across rear face 312 from side to side and has a width substantially coextensive with width W1 of baffle 300. Face mounting groove 320 may be oriented substantially parallel to top and bottom 302, 304 of the baffle 300.

Figure 7A:
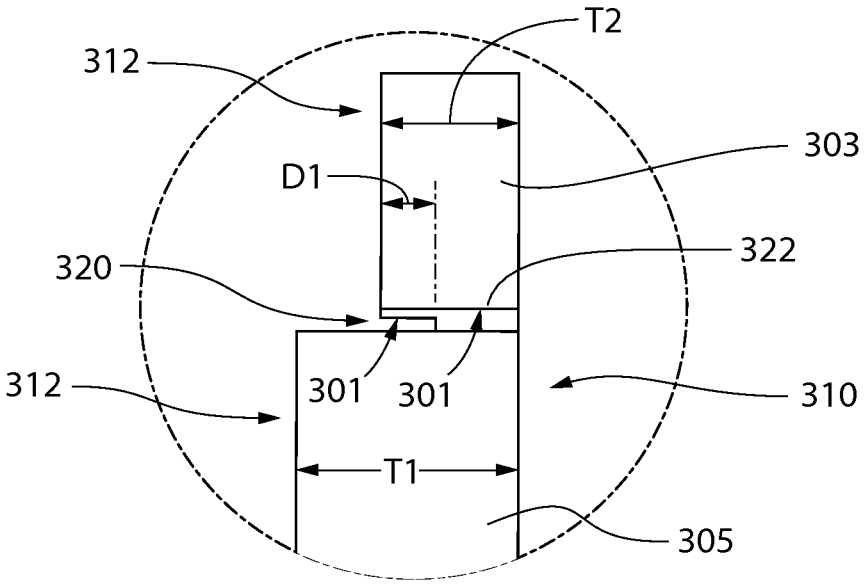
FIG. 7A is an enlarged detail taken from FIG. 7.

As best shown in FIG. 7A, the face mounting groove 320 extends from rear face 312 horizontally into baffle 300 towards front face 310 and partially penetrates the thickness T2 of the baffle upper section 303. Accordingly, face mounting groove 320 has a depth D1 less than both thicknesses T1 and T2 of baffle 300. In one embodiment, depth D1 is preferably sufficient to receive an inserted portion of bottom flange 210 of lateral grid support member 204 for securing baffle 300 to the support grid 200 in a stable manner. Depth D1 may be about one-half or less than the lateral width of bottom flanges 210 measured between the longitudinally extending opposed edges 214 of the bottom flange (see, e.g. FIGS. 4 and 7A). Face mounting groove 320 opens in a horizontal rearward direction (defined as a direction towards rear face 312).

With continuing reference to FIGS. 5-7 inclusive, the face mounting groove 320 may be considered to divide the vertical baffle 300 into an upper section 303 lying above groove 320 and a lower section 305 lying below the groove. Upper section 303 generally is positioned or located above bottom flange 210 of grid support members 202, 204, and therefore may not be visible to an observer from below the support grid 300 when the baffles and horizontal field ceiling tiles 400 (if provided) are fully mounted (see, e.g. FIG. 18). Conversely, lower section 305 generally is positioned or located below bottom flange 210 of grid support members 202, 204, and may generally be visible to an observer from below the support grid 300 when the baffles and horizontal field ceiling tiles 400 (if provided) are fully mounted.

Figure 3:
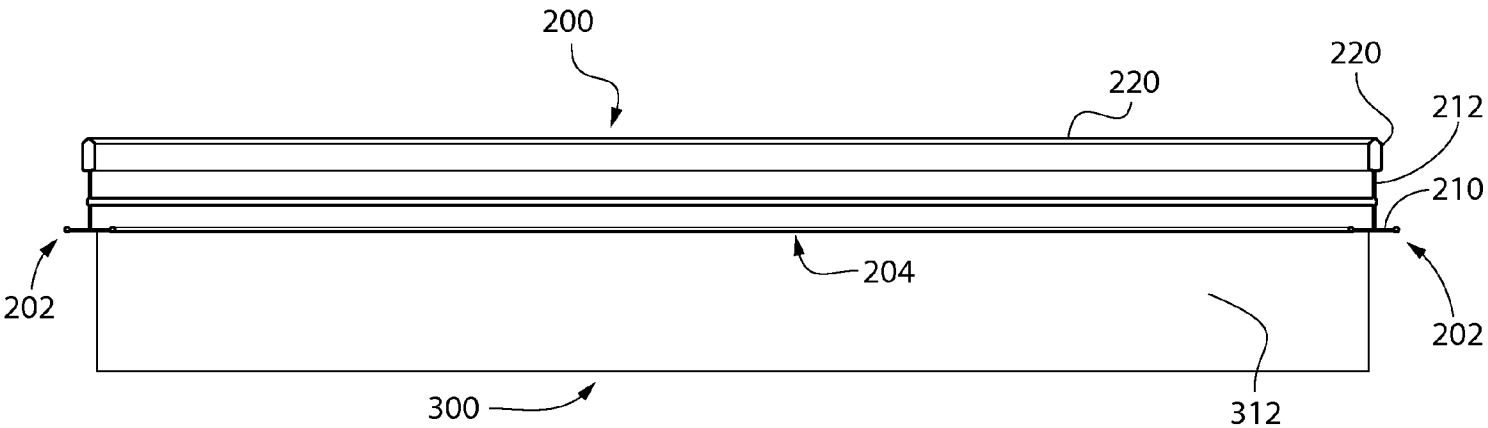
FIG. 3 is a side elevation partial cross-sectional view from FIG. 1.
Figure 3A:
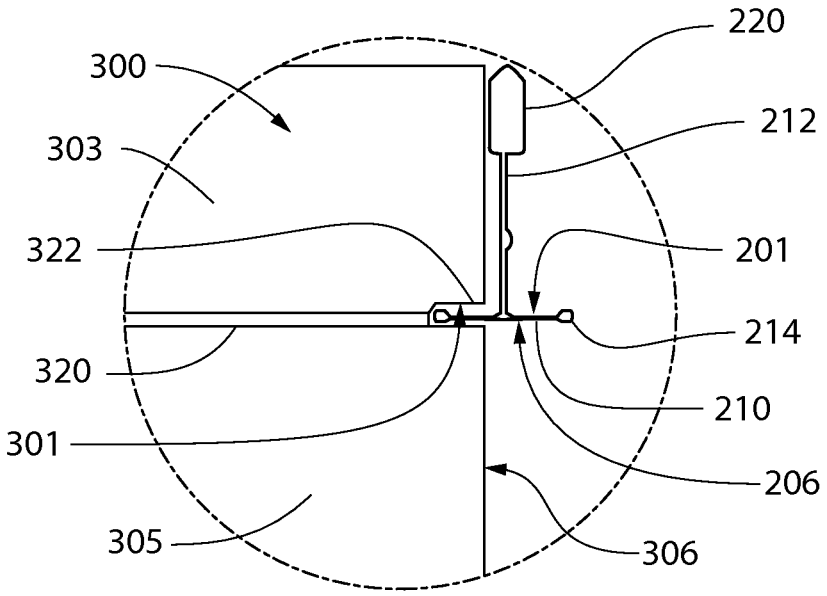
FIG. 3A is an enlarged side elevation partial cross-sectional view from FIG. 1 showing a first baffle mounting detail.
Figure 4:
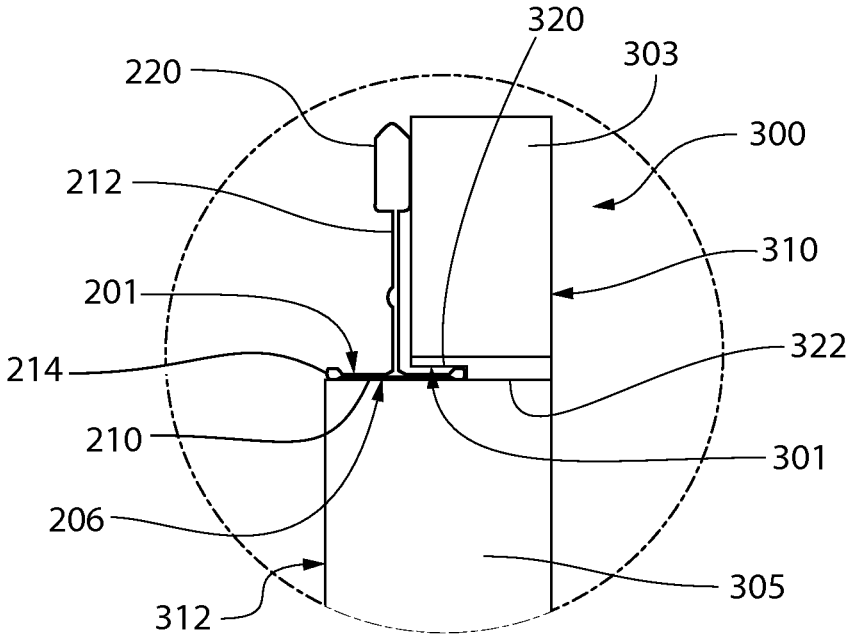
FIG. 4 is an enlarged side elevation partial cross-sectional view from FIG. 1 showing a second baffle mounting detail.

Referring also to FIGS. 3A and 4, upper section 303 of baffle 300 may have a vertical height which is approximately coextensive with or less than the vertical height of longitudinal and lateral grid support members 202, 204. In one exemplary embodiment, upper section 303 has a vertical height tall enough to abuttingly engage at least a portion of the top stiffening channel 220 of grid support members 202, 204 for enhancing lateral stability of the mounted vertical baffles 300. The visible lower section 305 of baffles 300 which extends below the grid support members 202, 204 may have any suitable height desired depending on the extent of the baffle which is to be visible and project into the occupied space beneath the support grid 200. The height selected may depend on factors such as ornamental appearance, acoustic performance (e.g. sound dampening or reflections), available head space, and others.

In one embodiment, upper section 303 of baffles 300 may have a thickness T2 that is less than the thickness T1 of lower section 305 (both measured between front and rear faces 310, 312). This provides the "stepped" rear face 312 in side profile shown in FIGS. 4 and 7 wherein the rear face or surface of upper section 303 is horizontally offset from and lies in a different vertical plane than the rear face or surface of lower section 305. Advantageously, this offset rear face 312 configuration allows at least part of the visible baffle lower section 305 to extend horizontally/laterally beneath and conceal bottom flange 210 of grid support members 202, 204. When adjacent horizontal field tiles 400 (if provided) are mounted to support grid 200 as shown in FIG. 17A, the grid support members 202, 204 may then be entirely concealed by the visible lower sections 305 of baffle 300 and field tiles 400 if desired.

Referring to FIGS. 5-7 inclusive, side mounting grooves 322 are each formed into a respective side 306, 308 of baffle 300 and extend between front and rear faces 310, 312 of the baffle. In one embodiment, each side mounting groove 322 extends completely across the sides 306, 308 from front face 310 to rear face 312 from side to side having a width substantially coextensive with the thickness T2 of upper section 303 of the baffle 300 (best shown in FIG. 7A). The side mounting grooves 322 may therefore intersect both front and rear faces 310, 312 in some embodiments. Side mounting grooves 322 may be oriented substantially parallel to top and bottom 302, 304 of the baffle 300.

Figure 6A:
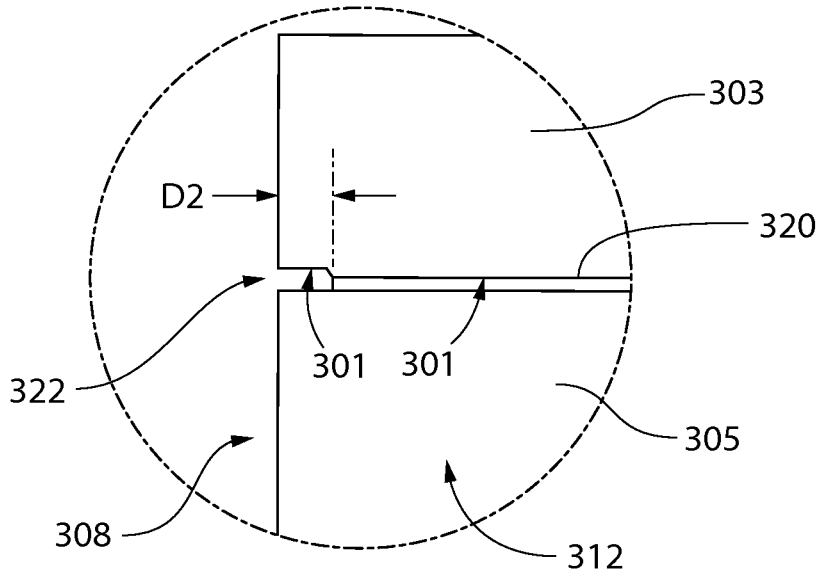
FIG. 6A is an enlarged detail taken from FIG. 6.

With continuing reference to FIGS. 5-7 inclusive, the side mounting grooves 322 horizontally extend from lateral sides 306, 308 inwards towards a vertical centerline of the baffle 300 (lying midway between sides 306 and 308) in the direction parallel to width W1. Side mounting grooves 322 partially penetrate the baffle upper section 303 in one embodiment; each groove 322 having a depth D2 less than width W1 of baffle 300. In one embodiment, depth D2 is preferably sufficient to receive an inserted portion of bottom flange 210 of grid longitudinal support members 202 for securing baffle 300 to the support grid 200 in a stable manner. Depth D2 may be about one-half or less than the lateral width of bottom flanges 210 measured between the longitudinally extending opposed edges 214 of the bottom flange (see, e.g. FIGS. 3A and 6A). Side mounting grooves 322 open outwards in a horizontal or lateral direction from baffle 300 (defined as a direction perpendicular to lateral sides 306 and 308).

When longitudinal grid support members 202 and lateral grid support members 204 are fully mounted, the bottom surfaces 206 of flanges 210 will substantially lie on the same horizontal plane. Accordingly, in an exemplary non-limiting embodiment, face mounting grooves 320 and side mounting grooves 322 may substantially lie on that same horizontal plane and intersect each other at two opposing corners of the rear face 312 of each vertical baffle 300 (see, e.g. FIGS. 6, 7, 6A, and 7A). This allows the side mounting grooves 312 to engage the bottom flanges 210 of two opposing and laterally spaced longitudinal grid support members 202 and the face mounting groove 310 of baffle 300 to engage the bottom flange 210 of a lateral grid support member 204 which spans between the two longitudinal grid support members (see FIG. 1). In this embodiment, the face and side mounting grooves 320, 322 and bottom flanges 210 of grid support members 202, 204 all substantially lie or fall on the same common horizontal mounting plane.

Face and side mounting grooves 320, 322 are configured for removably receiving portions of the bottom flange 210 of grid support members 202, 204 to mount vertical baffles 300 to support grid 200. Preferably, face and side mounting grooves 320, 322 have a height slightly larger than the thickness (vertical) of bottom flange 210 to allow the flange to be inserted, but not so large to allow excessive vertical play of the flange in the grooves to prevent wobbling of the baffles 300 particularly under indoor air currents induced by forced air HVAC (heating ventilating and air conditioning) systems or ingress/egress drafts. Each of the face and side mounting grooves 320, 322 define downward facing bearing surfaces 301 which engage upward facing bearing surfaces 201 on bottom flanges 210 which support the baffles 300 from the support grid 200. In one embodiment, the bearing surfaces 301 formed in face and side mounting grooves 320, 322 are contiguous and fall on the same horizontal plane to match bottom flanges 210 of grid support members 202, 204 which engage these support surfaces and similarly fall on the same horizontal plane.

Vertical baffles 300 may be formed of any suitable material, including without limitation mineral fiber board, fiberglass, jute fiber, metals, polymers, wood, or other. Face and side mounting grooves 320, 322 may be formed by any suitable fabrication method, including for example without limitation routing, cutting, molding, or others.

Figure 9A:
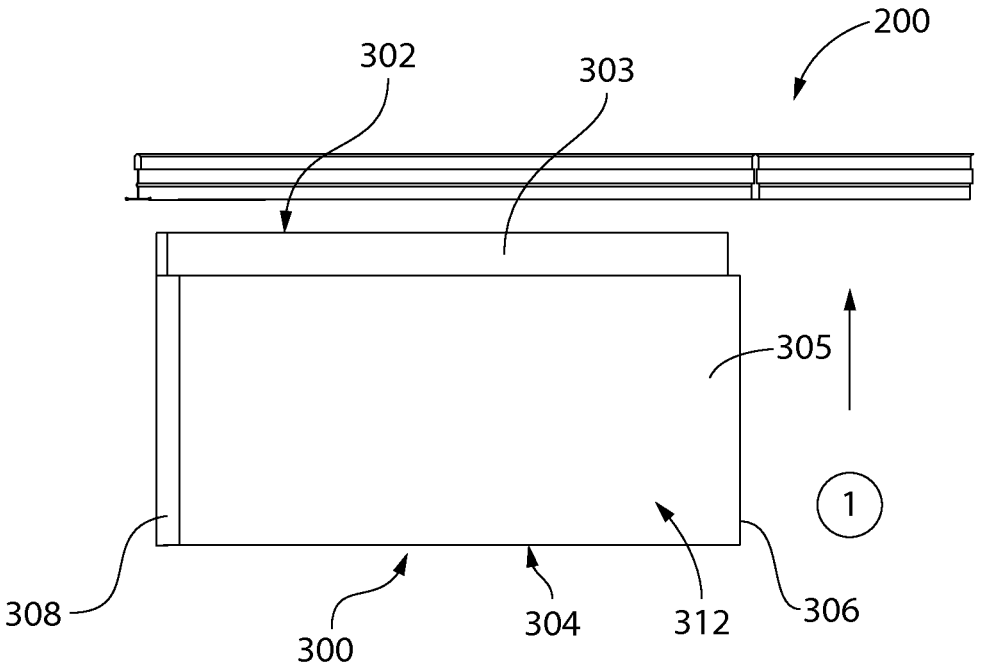
FIG. 9A is a side view showing a first step in a method for mounting the vertical baffle from the support grid.

A method for mounting a vertical baffle 300 to a support grid 200 of ceiling system 100 will now be described with primary reference to FIGS. 9A-C which shows sequential mounting steps.

The method includes first providing an overhead support grid 200 which has already been mounted and suspended from an overhead building support structure. Vertical baffle 300 is positioned below support grid 200 beneath one of the grid openings 208. The vertical baffle 300 is then raised upwards partially through the grid opening 208 until side mounting grooves 322 are horizontally aligned with bottom flanges 210 of longitudinal grid support members 202 (see, e.g. circled Step 1, FIG. 9A and FIG. 9B). Preferably, vertical baffle 300 is vertically oriented and obliquely positioned in grid opening 208 with respect to longitudinal and lateral grid support members 202, 204 when raised. In the present non-limiting embodiment, the width W1 of the vertical baffle is selected to be slightly wider than the lateral width measured between opposing edges 214 of the longitudinal grid support members 202 which border grid opening 208 for retaining vertical baffle 300 in the support grid 200 via baffle side mounting grooves 322.

Figure 8:
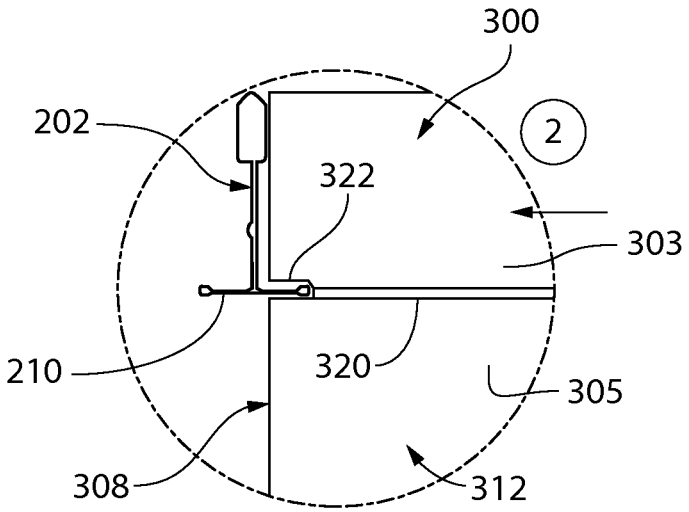
FIG. 8 is an enlarged mounting detail for mounting the vertical baffle to a grid support member of the support grid.
Figure 9B:
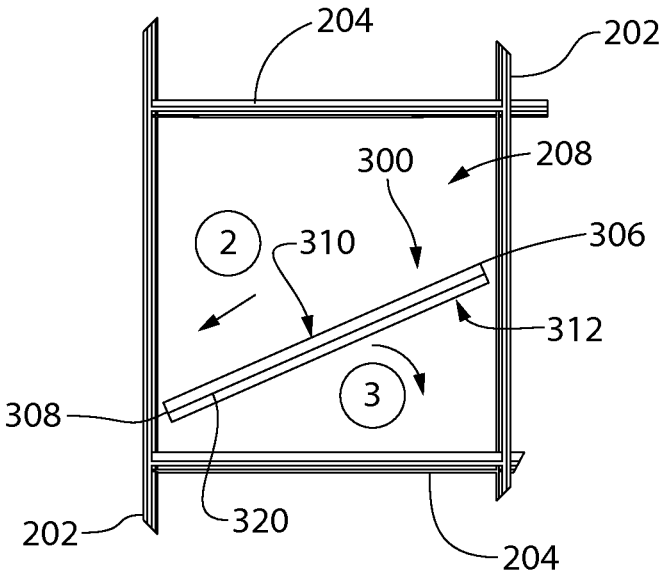
FIG. 9B is a top plan view showing a second and third step in the method for mounting the vertical baffle from the support grid.

With vertical baffle 300 in the foregoing oblique orientation, a first one of the lateral sides 306, 308 of vertical baffle 300 (e.g. side 308 in this non-limiting example as shown) is moved laterally into contact with one of the longitudinal grid support members 202 (see, e.g. circled Step 2, FIG. 9B). In one embodiment, this lateral motion may be substantially in a linear direction of side 308 towards the grid support member 202. The side mounting groove 322 of lateral side 308 is then engaged with bottom flange 210 of the longitudinal grid support member 202, as further shown in FIG. 8.

As further shown in FIG. 9B, the vertical baffle 300 is then rotated (clockwise in this figure about the vertical centerline of the baffle) while substantially maintaining engagement between side 308 and longitudinal grid support member 202 above and further maintaining the horizontal alignment between the bottom flanges 210 of the opposing longitudinal grid support members 202 and both side mounting grooves 322 of the baffle lateral sides 306 and 308. The remaining second one of the lateral sides 306 (in this example) is then moved laterally into contact with the remaining longitudinal grid support member 202 engaging side mounting groove 322 with the bottom flange 210 of the grid support member, as shown (see, e.g. circled Step 3). In one embodiment, this lateral motion may be substantially angular in direction in moving side 306 towards the grid support member 202 as the vertical baffle is rotated. Vertical baffle 300 is rotated until the baffle is substantially parallel in orientation (in the top plan view shown) with respect to the lateral grid support member 204 on which the baffle will be further mounted (see, e.g. FIG. 9C). Vertical baffle 300 is now also oriented perpendicular to both longitudinal grid support members 202 on either side. Both mounting grooves 322 on lateral sides 306, 308 are now fully engaged with the opposing longitudinal grid support members 202. The vertical baffle 300 is fully supported by the bottom flanges 210 of longitudinal grid support members 202 such that an installer may release the baffle if desired without providing supplemental support.

It will be appreciated that in some variations of the forgoing mounting method described thus far, the vertical baffle 300 may simply be rotated once obliquely positioned in grid opening 208 to simultaneously engage both lateral sides 306, 308 with a respective longitudinal grid support member 202, in lieu of one lateral side at a time in the sequential manner described above. Either installation approach is acceptable.

Figure 9C:
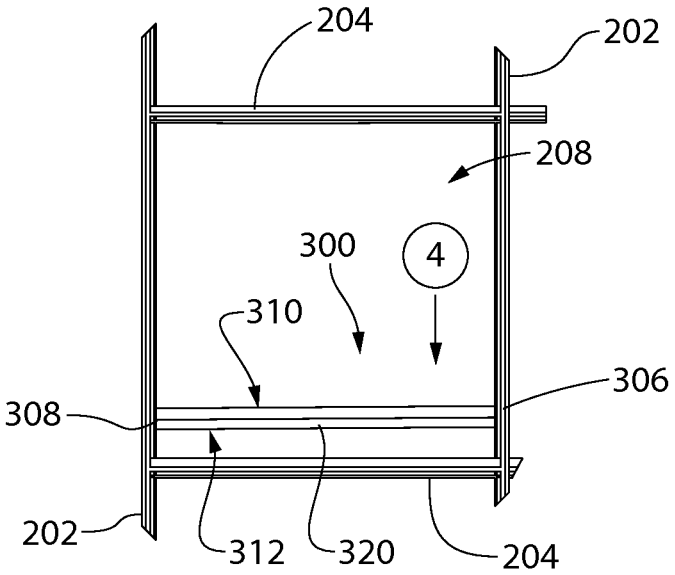
FIG. 9C is a top plan view showing a fourth step in the method for mounting the vertical baffle from the support grid.

With the vertical baffle 300 now oriented orthogonally with respect to grid support members 202, 204 as shown in FIG. 9C, the vertical baffle 300 is slidably moved along longitudinal grid support members 202 towards lateral grid support member 204 in an axial direction parallel to longitudinal axis LA1 (see also FIG. 1). Vertical baffle 300 is slid until face mounting groove 320 engages bottom flange 108 on the lateral grid support member 204 facing toward rear face 312 of the baffle (see, e.g. circled Step 4, FIG. 9C). The vertical baffle 300 is now fully mounted and engaged on three adjoining sides with support grid 200, as shown in FIG. 1. Vertical baffle 300 is simultaneously engaged via face and side mounting grooves 320, 322 with both lateral grid support members 204 and one of the longitudinal grid support members 202 bordering the grid opening 208. Assuming that the support grip 200 has been squarely installed, mounting of additional vertical baffles 300 in other grid openings 208 will ensure that the baffles are properly positioned and registered to provide a clean and orthogonal linear visual.

Figure 10:
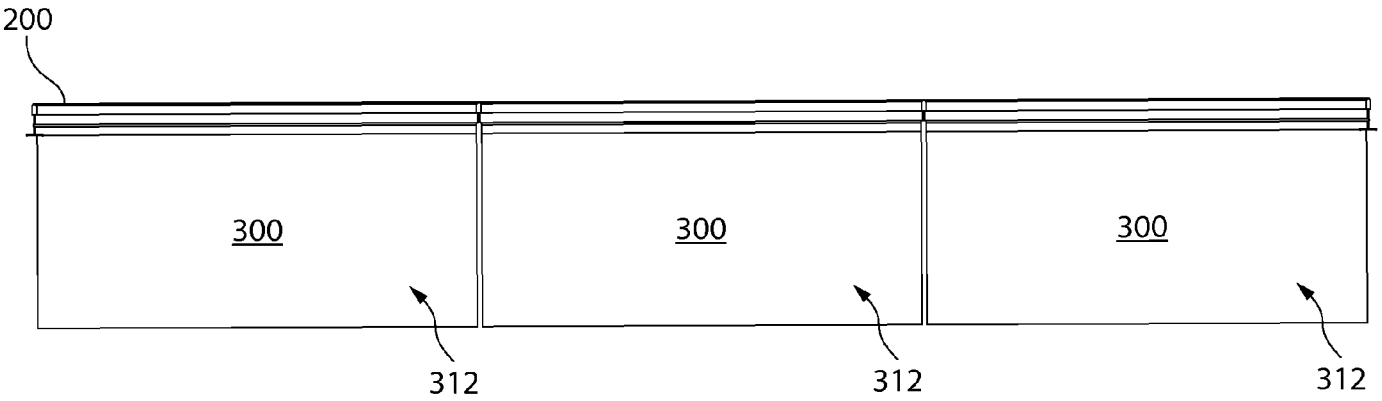
FIG. 10 is a side elevation view taken from FIG. 1 showing multiple vertical baffles mounted to the support grid.
Figure 12:
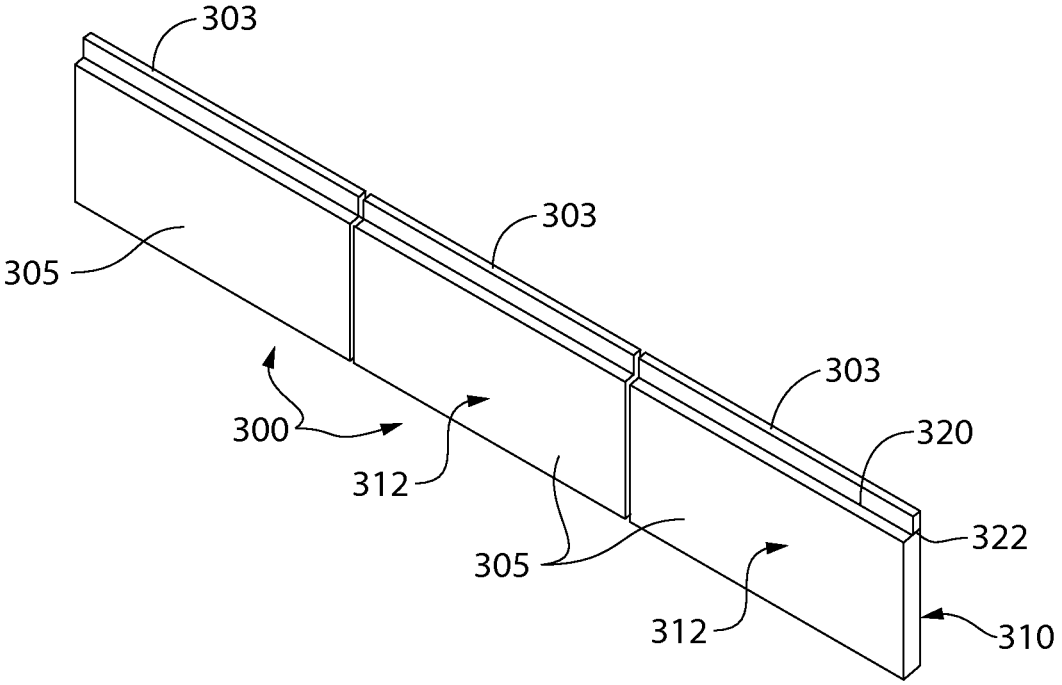
FIG. 12 is a perspective view of the baffle arrangement of FIGS. 1 and 10.
Figure 14:
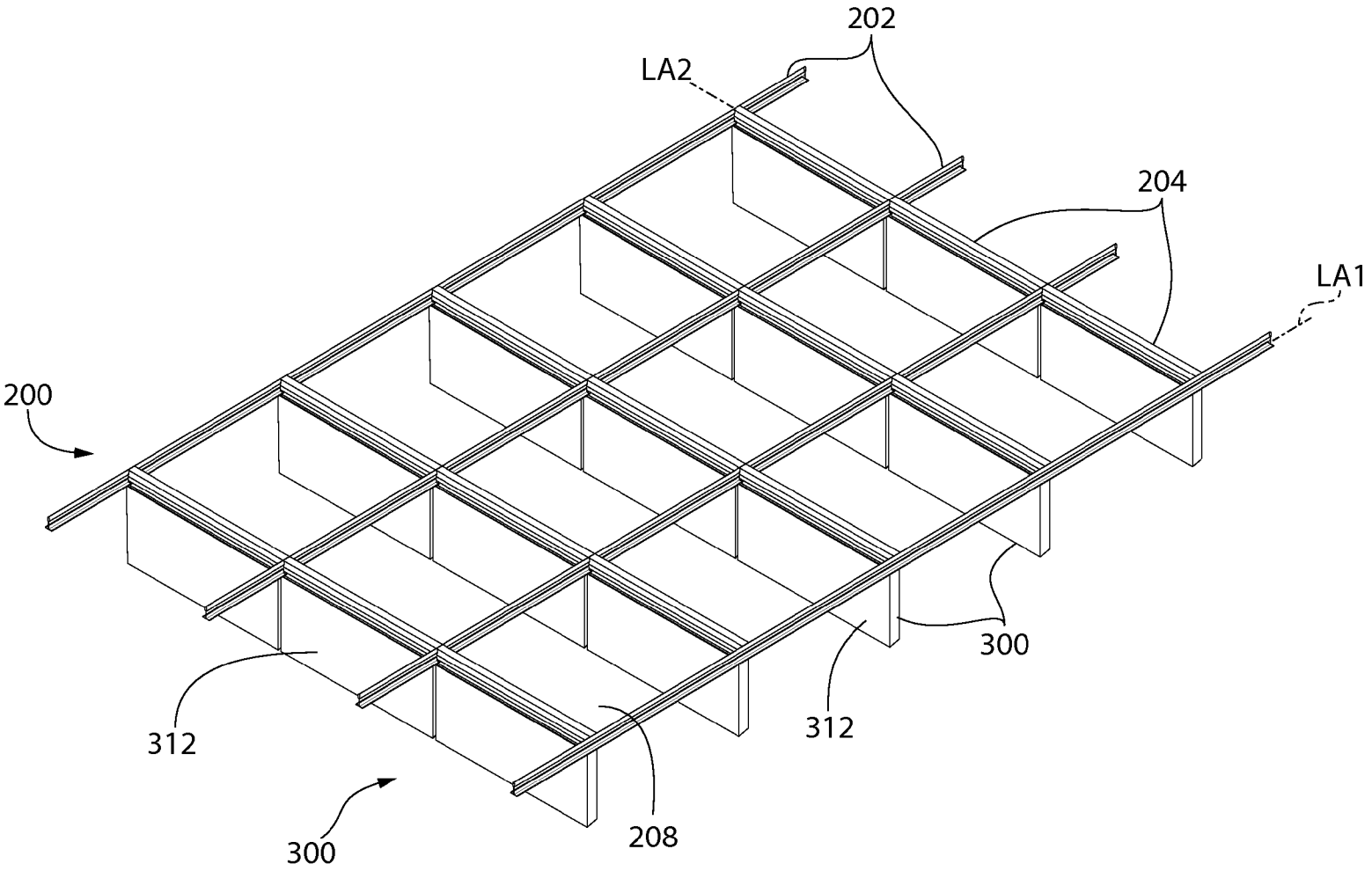
FIG. 14 is a perspective view showing one mounting arrangement of vertical baffles.

FIG. 10 shows a rear elevation view of the vertical baffle 300 installation taken from FIG. 1 along section line "X." Three vertical baffles 300 are shown installed in three adjacent and adjoining grid openings 208 in the support grid 200. FIG. 14 shows an exemplary non-limiting arrangement of vertical baffles 300 mounted to support grid 200 in a similar manner to that shown in FIG. 10 having a baffle installed in each available grid opening 208. FIG. 12 shows this arrangement of vertical baffles 300 disembodied from the support grid 200 to better show the relation of the vertical baffles alone in this mounting scenario. A vertical joint is visible adjacent vertical baffles 300 in each linear row as shown.

Figure 15:
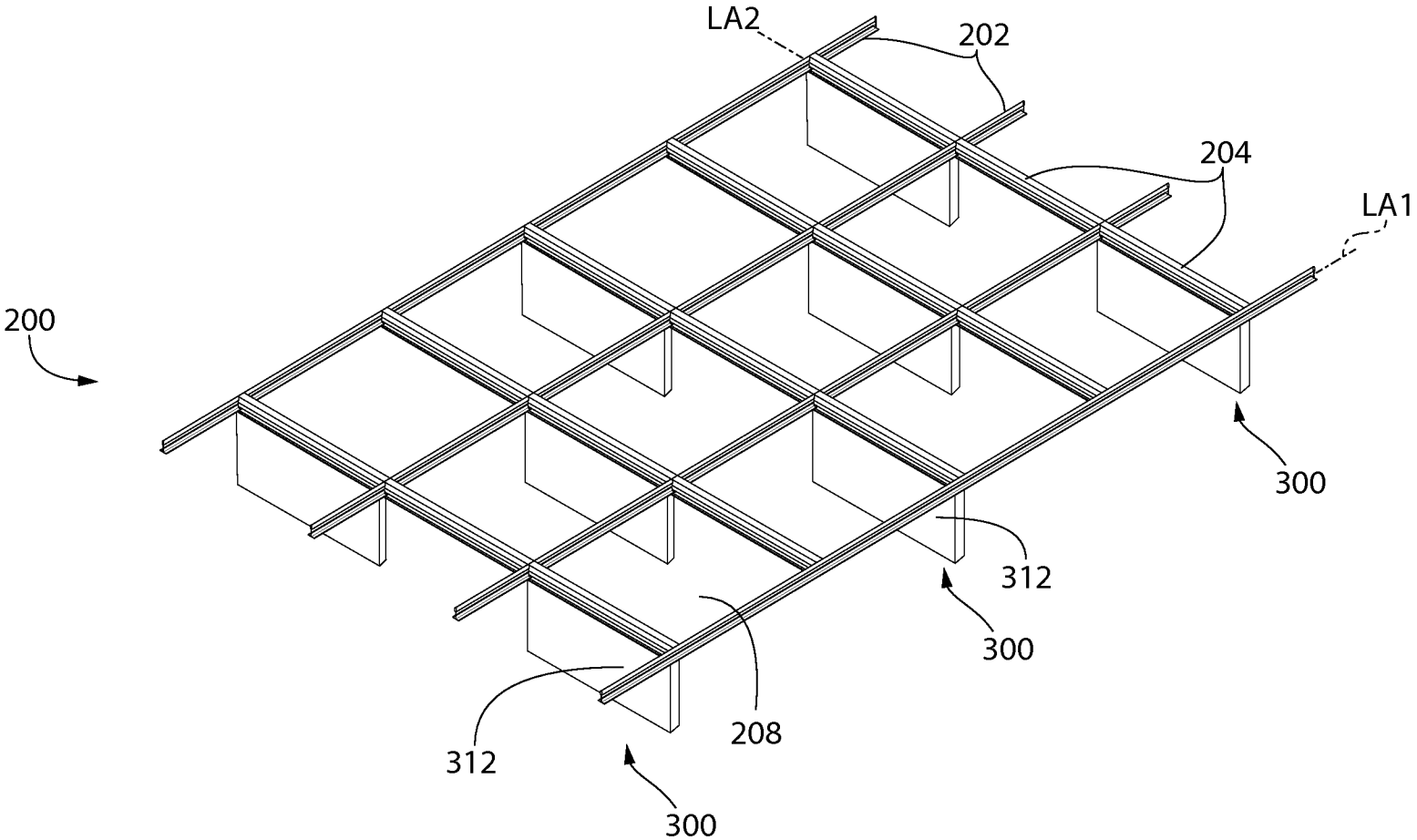
FIG. 15 is a perspective view showing another mounting arrangement of vertical baffles in an alternating pattern.

FIG. 15 shows an alternative arrangement in which vertical baffles 300 are installed in a staggered and alternating arrangement skipping a grid opening 208 in each lateral row (i.e. between longitudinal grid support members 202). A grid opening is hence also skipped in each longitudinal row (i.e. between lateral grid support members 204. It will be evident that numerous arrangements and arrays of vertical baffles 300 are possible and the invention is not limited to any particular arrangement.

Figure 11:
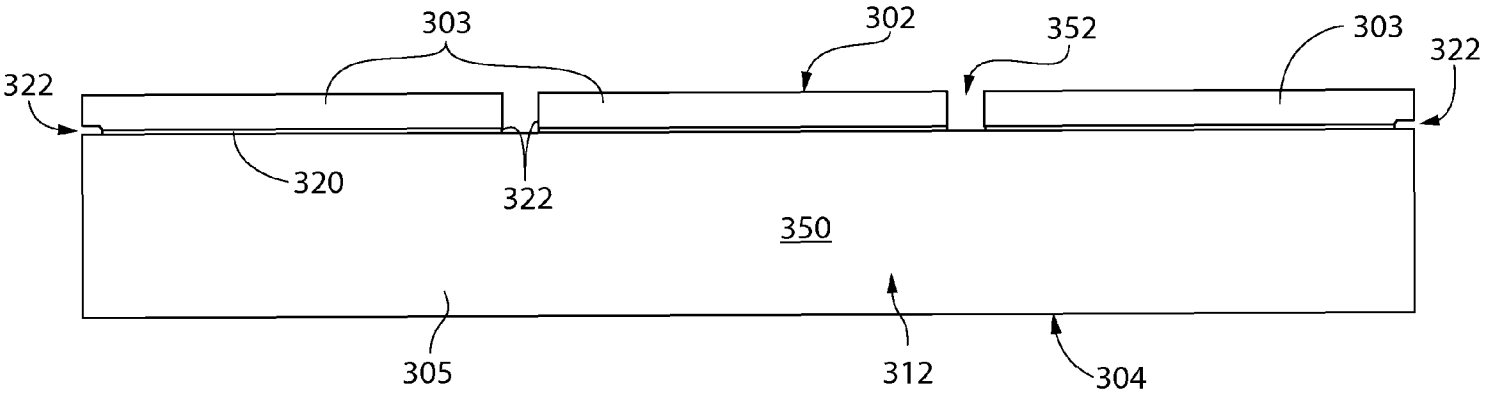
FIG. 11 is a side elevation view of an alternative embodiment of a vertical baffle having a lateral width capable of spanning across multiple grid openings of the support grid.
Figure 13:
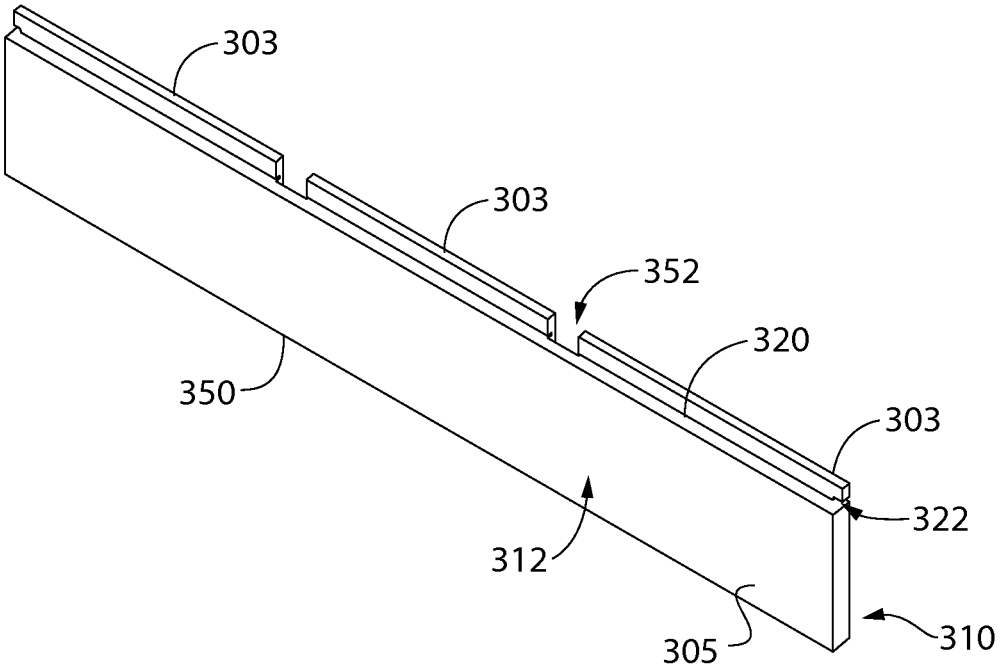
FIG. 13 is a perspective view of the alternative embodiment of the vertical baffle of FIG. 11.
Figure 16:
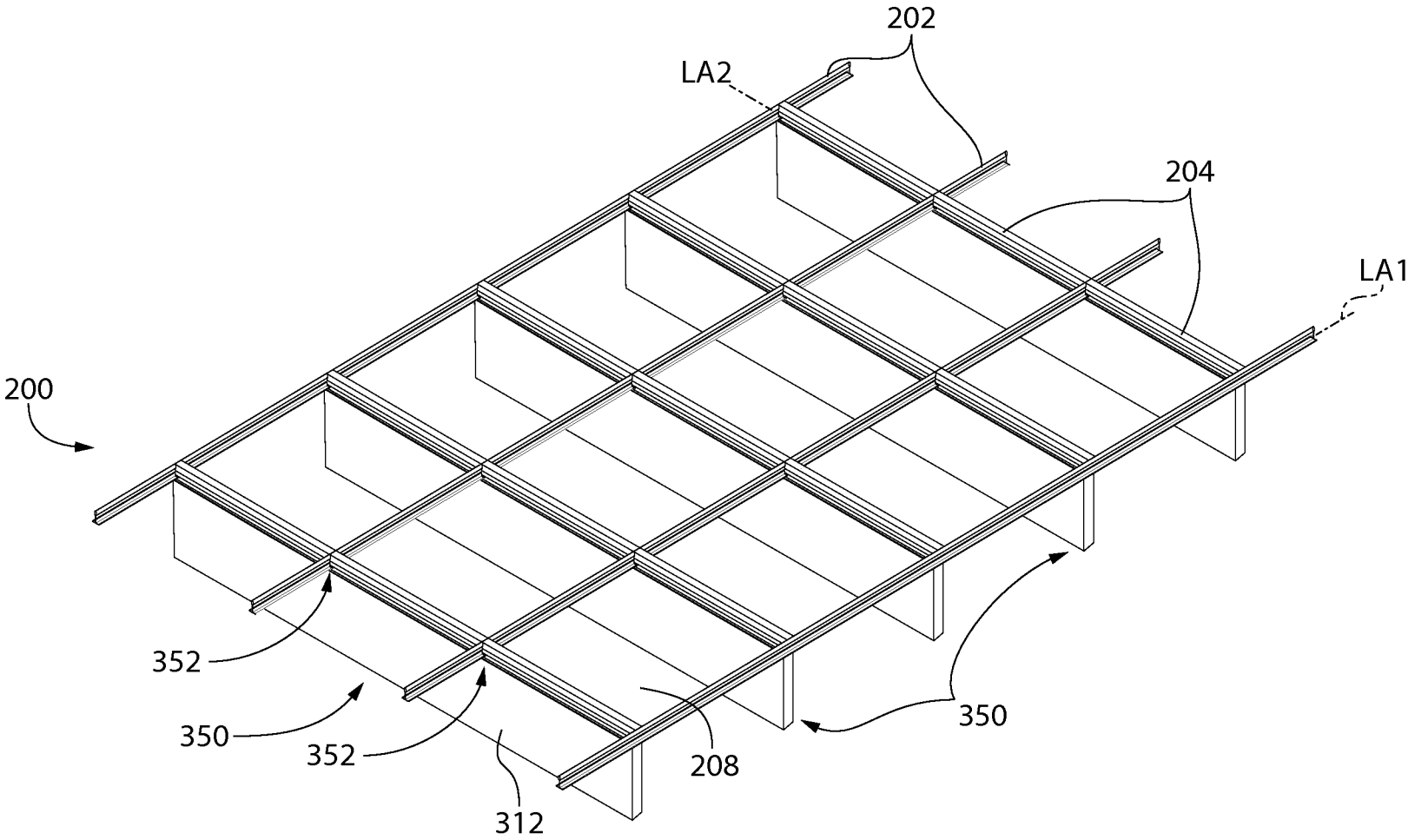
FIG. 16 is a perspective view showing a mounting arrangement of the alternative embodiment of the vertical baffle of FIG. 11.

In the ceiling systems 100 described thus far, the vertical baffles 300 have been configured and dimensioned to fit within a single grid opening 208. This creates a series of interrupted front faces 310 between baffles 300 with vertical joints therebetween positioned near and beneath each longitudinal grid support member 202. FIGS. 11, 13, and 16 show an alternative configuration of a vertical baffle 350 having a unitary structure which is designed to span across two or more adjacent grid openings 208 (and three or more longitudinal grid support members 202). This creates a continuous front face 310 for a certain width between at least two or more longitudinal grid support members 202 and grid openings 208.

With continuing reference to FIGS. 11, 13, and 16, vertical baffle 350 has a lateral width (identified as W1 in FIG. 6) larger than the corresponding lateral width or opening measured between opposing parallel longitudinal grid support members 202 (best shown in FIG. 16). The baffle upper section 303 is interrupted by one or more laterally spaced apart grid mounting gaps 352 each sized to receive at least partially therein a longitudinal grid support member 202. The gaps 352 have a lateral width preferably slightly larger than the lateral width of bottom flanges 210 of grid support members 202 for inserting the flanges into the gaps. The gaps 352 are further wide enough to allow the vertical baffle 350 to be positioned obliquely within two or more grid openings 208 and then rotated into the fully mounted position (see FIG. 16) in a similar manner to mounting vertical baffle 300 as described in the foregoing method. In the non-limiting embodiment shown, there are two vertical grid mounting gaps 352 and the vertical baffle 350 spans across three grid openings 208. Other suitable lateral widths and numbers of gaps 352 may be provided in other configurations and variations of the vertical baffle 350 depending on the width of vertical baffle 35 provided.

In non-limiting exemplary embodiments, vertical baffle 350 may be similar in other construction details to vertical baffle 300 including the provision of face and side mounting grooves 320, 322. In some embodiment, side mounting grooves 322 may also be formed within the grid mounting gaps 352 in the baffle upper section 303 to further support the vertical baffle 350. In other embodiments, the side mounting grooves 322 may only be provided at the lateral sides 306, 308.

Figure 17:
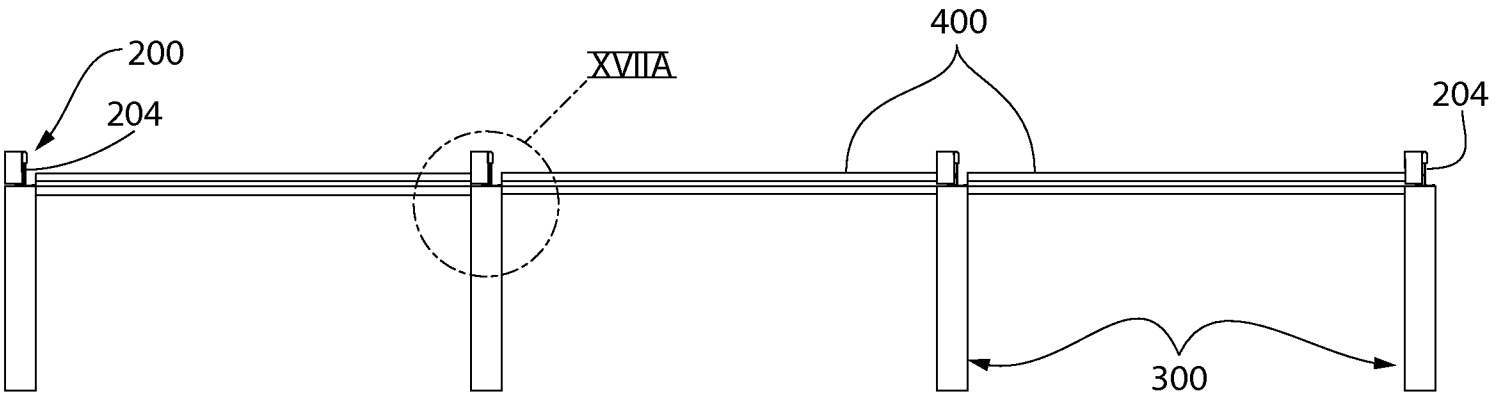
FIG. 17 is a side elevation view showing the vertical baffles mounted in the support grid with horizontal field tiles.
Figure 17A:
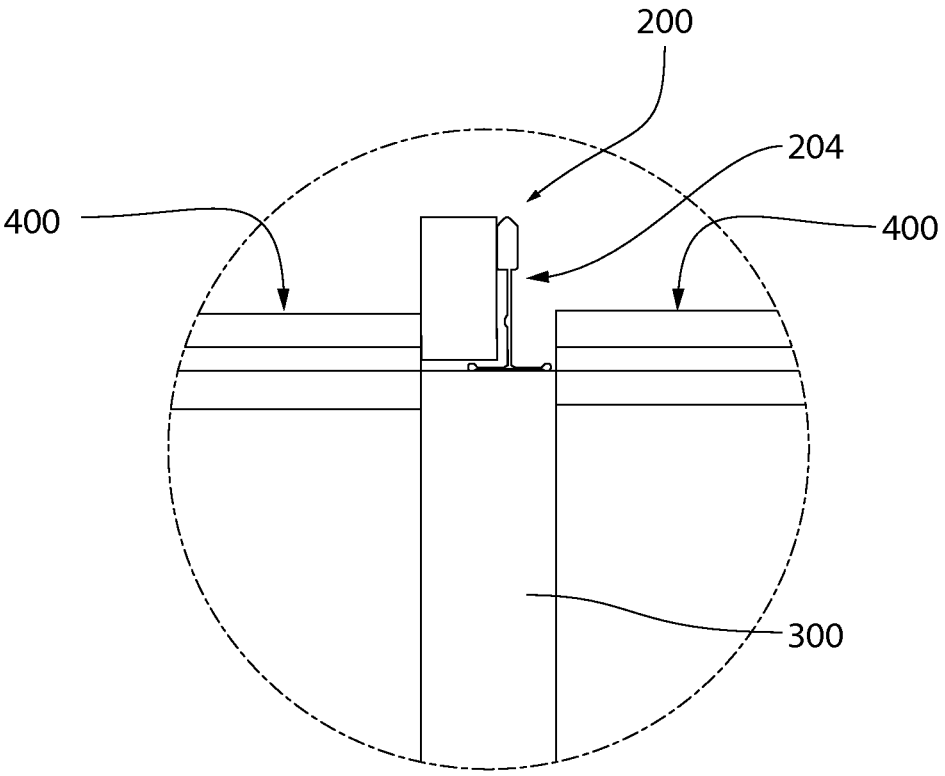
FIG. 17A is an enlarged detail taken from FIG. 17.
Figure 18:
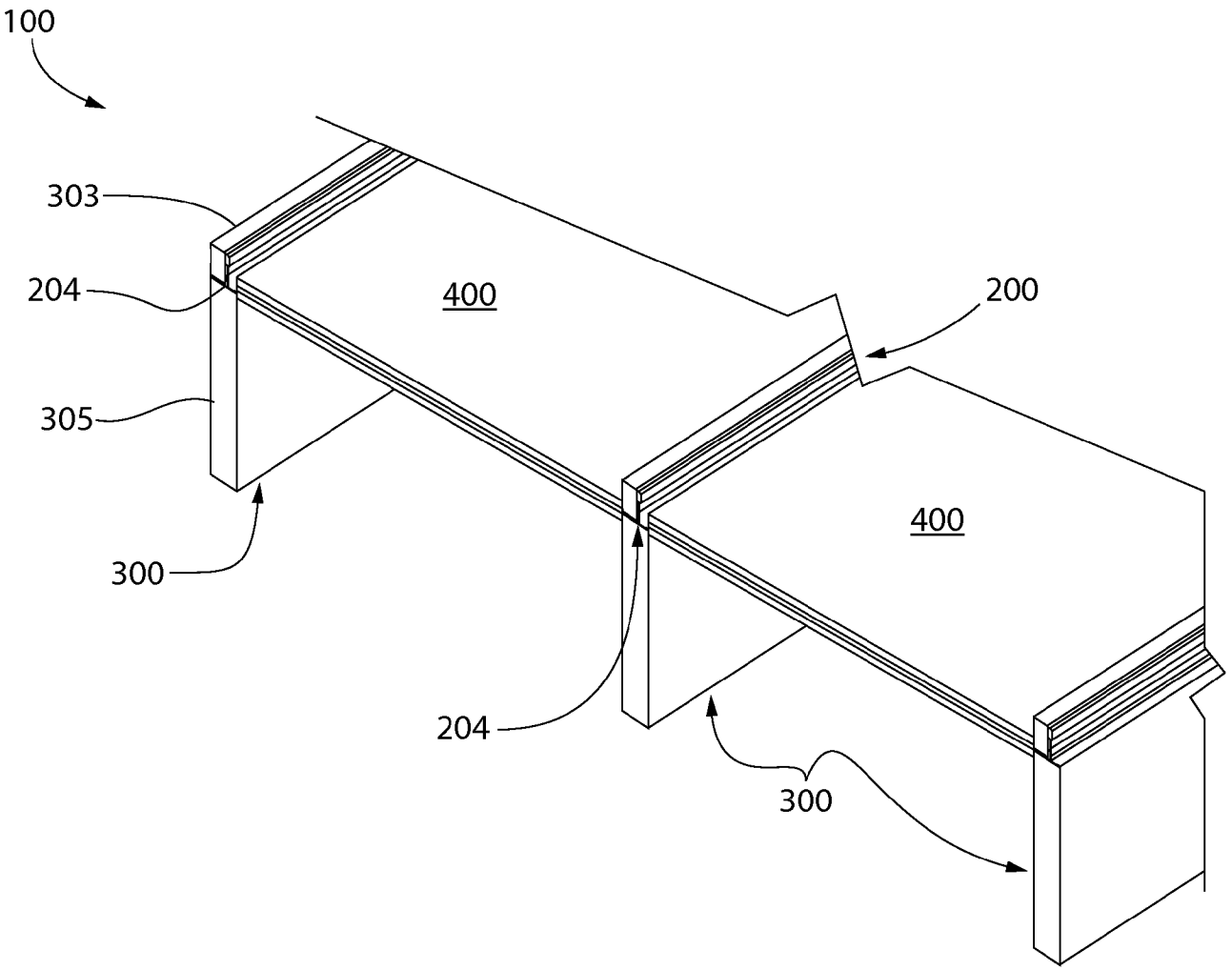
FIG. 18 is a perspective view showing the vertical baffles mounted in the support grid with horizontal field tiles.

FIGS. 17 and 18 show an exemplary continuous version of ceiling system 100 including vertical baffles 300 and horizontal field tiles 400 which fill the voids in grid openings 208 between the vertical baffles and grid support members 202, 204. FIG. 17A is a cross-section detail of the joint formed between the field tiles 400 and a vertical baffle 300 at a lateral grid support member 204. The field tiles 400 may be abutted against vertical baffles 300 and supported from the support grid 200 in any suitable manner used in the art. Horizontal field tiles 400 may have any suitable lateral edge profile, including square lay-in edges, tegular edges, or others. In some embodiments, the lateral edges may rest on top of bottom flanges 210 of the grid support members 202, 204 when mounted in a known manner. Clips or brackets (not shown) may further be used to mount the field tiles 400 to grid support members 202, 204 in certain embodiments.

It will be appreciated that in some embodiments having an open ceiling concept or system, vertical baffles 300 or 350 may be used alone and mounted on support grid 200 without horizontal field tiles 400. Accordingly, the invention is not limited in any manner to either the use or absence of horizontal field tiles 400 in the ceiling system 100.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling system comprising:

a suspended support grid comprising a plurality of intersecting grid support members arranged horizontally and forming grid openings between the plurality of intersecting grid support members, the plurality of intersecting grid support members comprising a first grid support member, a second grid support member, and a third grid support member, the first, second and third grid support members extending substantially parallel to one another, and the second grid support member being located between the first and third grid support members;

a vertical panel attached to the suspended support grid, the vertical panel comprising:

a first lateral side edge;

a second lateral side edge opposite the first lateral side edge;

a top edge;

a bottom edge opposite the top edge;

a front face;

a rear face opposite the front face;

a first side mounting groove formed in the first lateral side edge, the first side mounting groove extending from the front face to the rear face;

a second side mounting groove formed in the second lateral side edge, the second side mounting groove extending from the front face to the rear face;

the vertical panel mounted to the suspended grid support by the first side mounting groove engaging the first grid support member and the second mounting groove engaging the third grid support member, the second grid support member at least partially nesting within and extending through a first mounting channel formed in the top edge of the vertical panel between the first and second lateral side edges.

2. The system of claim 1, further comprising a face mounting groove formed in the front face, the face mounting groove extending from the first lateral side edge to the second lateral side edge.

3. The system of claim 2, wherein the plurality of intersecting grid support members comprises a fourth grid support member extending substantially perpendicular to the first and third grid support members; and wherein the face mounting groove engages the fourth grid support member.

4. The system of claim 2, wherein the vertical panel comprises an upper section above the face mounting groove having a first thickness measured from the front face of the vertical panel to the rear face of the vertical panel and a lower section below the face mounting groove having a second thickness measured from the front face to the rear face, the first thickness being less than the second thickness.

5. The system of claim 4, wherein the first mounting channel is formed in the upper section of the vertical panel.

6. The system of claim 4, wherein the upper section of the vertical panel has a lower surface, the lower surface being in contact with one of the grid support members.

7. The system of claim 1, wherein the first channel extends from the front face to the rear face.

8. The system of claim 1, wherein each of the plurality of the intersecting grid support members comprises an inverted T-shaped cross-section.

9. The system of claim 1, wherein the vertical panel is formed of mineral fiber, fiberglass, or jute fiber.

10. The system of claim 3, wherein the vertical panel has a second mounting channel formed in the top edge and extending between the front and rear faces, the second channel spaced from the first channel.

11. The system of claim 10, wherein the plurality of intersecting grid support members further comprises a fifth grid support member extending substantially parallel to the first and third grid support members, the fifth grid support member at least partially nesting within and extending through the second channel.

12. The system of claim 1, wherein the first mounting channel has a width greater than a width of the second grid support member.

13. The system according to claim 1, wherein the first mounting channel extends completely through the top edge between the front and rear faces of the vertical panel.

14. The system according to claim 1, wherein the vertical panel is in a vertical position when the vertical panel is fully mounted in a normal operating state in the support grid.

15. A ceiling system comprising:

a suspended support grid comprising a first grid support member, a second grid support member, and a third grid support member, the second grid support member being located between the first and third grid support members, a vertical panel attached to the suspended support grid, the vertical panel comprising:

a front face;

a rear face opposite the front face;

a top edge extending between the front face and the rear face;

a second lateral side edge extending from the front face to the rear face;

a first channel formed in the top edge and extending from the front face to the rear face;

the vertical panel mounted to the suspended grid support and supported by the first grid support member and the third grid support member, the second grid support member at least partially nesting within and extending through the first channel formed in the top edge of the vertical panel.

16. The system of claim 15, wherein the rear face is a stepped surface comprising a first riser surface, a tread surface, and a second riser surface horizontally offset from the first riser surface.

17. The system of claim 15, further comprising a face mounting groove formed in the front face, the face mounting groove extending from the first lateral side edge to the second lateral side edge.

18. The system of claim 17, wherein the plurality of intersecting grid support members comprises a fourth grid support member extending substantially perpendicular to the first and third grid support members; and wherein the face mounting groove engages the fourth grid support member.

19. The system of claim 15, wherein the vertical panel comprises an upper section having a first thickness measured from a front face of the vertical panel to a rear face of the vertical panel and a lower section having a second thickness measured from the front face to the rear face, the first thickness being less than the second thickness.

20. The system of claim 15, wherein the front and rear faces each have a width measured between the first and second lateral side edges which is larger than a thickness of the first and second lateral side edges of the panel measured between the front and rear faces.

21. The system of claim 15, further comprising a first side mounting groove formed in the first lateral side edge and engaging the first grid support member, and a second side mounting groove formed in the second lateral side edge engaging the third grid support member.

* * * * *